United States Patent [19]

Röther et al.

[11] Patent Number: 4,709,856

[45] Date of Patent: Dec. 1, 1987

[54] ELECTRICAL AND MECHANICAL COUPLING FOR MODEL RAIL SECTIONS

[75] Inventors: Helmut Röther, Wangen; Manfred Reyher, Hattenhofen, both of Fed. Rep. of Germany

[73] Assignee: Gebr. Marklin & Cie. GmbH, Fed. Rep. of Germany

[21] Appl. No.: 916,832

[22] Filed: Oct. 9, 1986

[30] Foreign Application Priority Data

Oct. 15, 1985 [DE] Fed. Rep. of Germany ..... 3536631

[51] Int. Cl.[4] ..... E01B 23/04; E01B 11/54

[52] U.S. Cl. ..... 238/10 E; 238/10 R; 238/14.05

[58] Field of Search ..... 238/10 R, 10 A, 10 E, 238/10 F, 14.05, 14.4, 14.12; 191/29 R, 32; 104/DIG. 1, 288; 339/22 B

[56] References Cited

U.S. PATENT DOCUMENTS

| | | | |
|---|---|---|---|
| 1,482,639 | 2/1924 | Fergusson | 238/10 E X |
| 3,074,647 | 1/1963 | Bonanno | 238/10 E |
| 3,916,089 | 10/1975 | Sloan | 191/32 X |

FOREIGN PATENT DOCUMENTS

| | | |
|---|---|---|
| 1728426 | 3/1972 | Fed. Rep. of Germany . |
| 3231161 | 2/1984 | Fed. Rep. of Germany . |
| 3405506 | 11/1984 | Fed. Rep. of Germany . |

OTHER PUBLICATIONS

Eisenbahn Magazin 5/84 "Das Kato-Gleissystem aus Japan".

Leaflet referring to products of Ludwig Conrad & Co. KG.

*Primary Examiner*—Robert B. Reeves

*Assistant Examiner*—Scott H. Werny

*Attorney, Agent, or Firm*—Lorusso & Loud

[57] ABSTRACT

A coupling for two adjacent rail sections of a model railway has a bed member with rails and conductor rail held thereon and downwardly extending projections electrically connected to the rail and conductor rail. A coupling member is arranged beneath the bed members and has two upwardly opening, electrically conductive, elastic, locking elements that engage the extending projections such that projections on adjacent rail sections are mechanically and electrically connected. One locking element comprises upwardly protruding elastic tongues that interlock with the projections, and the other locking element comprises two parallel spring wires, connected by a contact spring and set apart by spacers such that projections are insertable there between. A locking element, on the underside of the coupling member, forms the elastic tongues. A connecting element, resting against the locking element, protrudes on both sides of the coupling member in the form of a contact lug.

20 Claims, 8 Drawing Figures

ELECTRICAL AND MECHANICAL COUPLING FOR MODEL RAIL SECTIONS

BACKGROUND OF THE INVENTION

The invention relates to a coupling for two adjacent rail sections of a model railway comprising a bed member with rails and a conductor rail held thereon, wherein there is arranged beneath the adjacent bed members a coupling member carrying at least two upwardly locking elements consisting of electrically conductive material which are elastically deformable and are not joined to one another, and in which projections which are in electrically conductive connection with the rails and the conductor rail, respectively, are engageable from above, whereby the projections corresponding to one another on the adjacent rail sections are mechanically and electrically connectable to one another via one locking element, in each case, and one locking element carries upwardly protruding elastic tongues, with the projections engageable in this locking element resting thereagainst.

In a known coupling member arranged beneath two adjacent rail sections, mechanical and electrical connections can be made between the rail sections by vertical pressing of the rail sections onto the coupling member from above (German Offenlegungsschrift No. 3 405 506). This readily enables removal of a rail section from a finished rail track without the other rail sections of the rail track having to be moved.

In a similar coupling member, it has already been suggested that the electrical and mechanical connections be made by joining projections protruding downwardly from the rails and conductor rails to the coupling member so that no connection means whatever are visible on the upper side of the rail section (German Patent Application No. P 34 14 503.6). With this known coupling member, the mechanical and electrical connection is made by the projections on the rails and conductor rails being clamped in between two spring tongues extending parallel to each other, and these spring tongues are all arranged parallel to the rail direction. To ensure a mechanically reliable connection of the adjacent rail sections, in this case, additional measures must be taken, for example, the coupling member must be additionally locked to the bed member of the two rail sections.

SUMMARY OF THE INVENTION

The object underlying the invention is to improve a generic rail coupling so that with the electrical coupling of the two rail sections, a reliable mechanical coupling is simultaneously established without the necessity for additional fixing means.

This object is achieved in accordance with the invention with a coupling of the kind described at the outset by the other locking element comprising for each projection of the two adjacent rail sections, two spring wires attending parallel to each other, whose distance apart is set by at least one spacer, and by the projection provided with a recess being insertable between these in an area beside the spacer in which the spring wires can be elastically bent apart.

Use of a locking element comprised of two spring wires extending parallel to each other, in conjunction with a projection provided with a recess, ensures a particularly secure and stable connection, so that such a design eliminates the need for additional mechanical fixing members.

In this case, it is particularly expedient for the spring wires to be fixed in mutually spaced-apart relation to each other by a spacer on either side of the insertion area. This contributes towards increasing the stability of the locking elements and, consequently, the firmness of the connection.

In the insertion area, the spring wires are preferably arranged transversely to the direction of travel, while the spring tongues of the other locking element usually extend parallel to the direction of travel. The two rail sections are thereby fixed transversely to the direction of travel by one locking element, and, on the other hand, parallel to the longitudinal direction by the spring wires extending transversely to the direction of travel.

The design of the coupling member may be made particularly simple by the two insertion areas for the projections corresponding to one another on the adjacent rail sections being formed by the same spring wires. It is then sufficient to provide a total of two spring wires for the coupling member which enable engagement of both rail sections.

In a preferred embodiment, provision is made for each spring wire to comprise a central portion and free ends adjoining it at right angles on either side, and for the two spring wires to be offset in relation to each other in the longitudinal direction of the central portion on the coupling member, and, with their free ends pointing in the opposite direction, to be arranged in such a way that the free ends of the two spring wires extend parallel to each other at least over part of their longitudinal extent.

In this case, the central portions preferably rest against the upper side of the coupling member, while the angular free ends are arranged in a plane extending above the upper side of the coupling member in spaced relation to the upper side of the coupling member.

It is particularly easy to assemble the spring wires on the coupling member if each spacer comprises two upwardly open, parallel grooves with laterally arranged, elastic detents behind which the spring wire is engageable from above.

The locking element carrying the elastic tongues can be arranged on the underside of the coupling member, with the elastic tongues protruding upwardly at opposite edges of the coupling member beyond a base plate of the coupling member. The mutual spacing between elastic tongues arranged in pairs in opposite relation to each other is thereby made relatively large so that particularly reliable protection against torsion is achieved when these tongues rest against corresponding projections of the rail sections.

The tongues may comprise at their upper ends projections behind which there engage corresponding projections on elastic tongues which protrude downwardly from the bed member. Cooperation of these projections protects the rail section from unintentional withdrawal of the rail from the coupling member in the upward direction.

In the case of a bed member made of electrically conductive material, where the rails are in electrically conductive connection with the bed member, while the conductor rail is insulated therefrom, it is expedient for the tongues protruding downwardly from the bed member to be in electrically conductive connection therewith. In this way, the electrical connection of the rails is established via these tongues and the locking element provided with elastic tongues without further connecting members.

In a preferred embodiment, provision is made for the locking element carrying the elastic tongues to comprise two flat strips extending parallel to the rail direction and resting against the underside of the coupling member, for the elastic tongues protruding upwardly at the adjacent edge of the coupling member to be formed on each strip, and for the two strips to be in electrically conductive connection with each other via two webs extending parallel to each other and perpendicularly to the strips. The strips, the tongues and the webs are preferably of integral construction, so that the first locking element may be connected as a unitary component to the coupling member, for example, by bendable tabs which are inserted through slits in the coupling member.

In this case, it is advantageous for a connecting element on the underside of the coupling member to protrude in the form of a contact lug beyond the outer contour of the coupling member. The connecting element rests in electrically conductive contact against the portion of the locking element carrying the elastic tongues that extends on the underside of the coupling member. By connecting a connection wire to the contact lug, an electrical connection can, therefore, be established with the rails, for example, with a connecting track for supplying the operating voltage.

It is expedient, in this case, for the connecting element to rest along one of the two strips on the locking element. This produces a large contact surface, which enables a reliable electrical contact to be established.

The connecting element may be fixed in downwardly open recesses of the coupling member, for example, by pegs formed on the coupling member which extend through openings in the connecting element and are widened at their free end.

In a preferred embodiment, provision is made for the central portions of the two spring wires to span an opening in the coupling member, for a contact spring which rests against the central portions of both spring wires to be arranged in this opening, and for a contact member made of electrically conductive material which presses the contact spring against the spring wires to be held on the underside of the coupling member and to protrude in the form of a contact lug beyond the outer contour of the coupling member. Via this contact lug, an electrically conductive connection can, therefore, be established with the spring wires and thus with the conductor rails of the rail sections.

In this case, it is advantageous for the opening and the contact spring to be H-shaped so that the contact spring rests with two spring arms against each central portion. This also serves to establish a particularly reliable electrical contact.

The contact member may extend in spaced relation beneath the webs which join the two strips of the locking element and in relation to the strip of the locking element are set back towards the interior of the coupling member. The locking element and also the connecting elements provided with contact lugs may thus be accommodated within an extremely small area on the coupling member.

It is particularly expedient for the connecting element resting against the locking element and also the contact member to form an integral component which is attached to the coupling member and which in its assembled position on the coupling member is separable into two parts which are electrically insulated from each other by severing two strips joining the contact member and the connecting element. Assembly is considerably simplified firstly by attachment of a unitary component to the coupling member and then by severing at two points only, so that two parts which are electrically insulated from each other are held on the coupling member.

If the connecting element and the contact member, in each case, protrude in the form of a contact lug on both opposite sides of the coupling member, beyond the latter, corresponding conections may be made beneath each of the two rail sections.

BRIEF DESCRIPTION OF THE DRAWINGS

The following description of preferred embodiments serve in conjunction with the drawings to explain the invention in greater detail. In the drawings.

DESCRIPTION OF THE PREFERRED EMBODIMENTS

Figure 1:
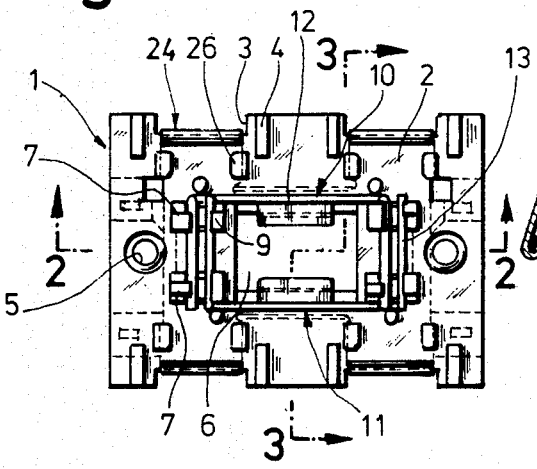
FIG. 1 is a plan view of a coupling member without the connecting element, without the contact spring and without the contact member.

The coupling member 1 illustrated in the drawings comprises a rectangular base plate 2, with two rectangular cut-out sections 3, in each case, arranged in spaced relation to each other, at its longitudinal edges. At the narrow sides of these cut-out sections 3, guide pegs 4 extending upwardly in a slightly conical manner protrude from the base plate 2.

The base plate 2 comprises at each of its narrow sides a through bore 5 for accommodation of a fastening screw. The base plate furthermore exhibits a central, H-shaped opening 6, whose parallel portions extend parallel to the narrow sides of the coupling member.

Arranged between the bore 5 and the opening 6 on either side of the opening 6 are, in each case, two spacers 7 arranged in spaced relation to each other, which protrude upwardly from the base plate 2 and comprise on their upper side two grooves 8 extending parallel to each other. In the area of these grooves, the walls of the spacers 7 form elastic detents 9 which fix in the grooves spring wires 10 and 11 pressed into the grooves from above.

Each of the two spring wires 10 and 11 comprises a straight-lined central portion 12 and at opposite ends two free ends 13 protruding at right angles from the central portion 12. The free ends 13 are joined to the central portion by a vertical intermediate section 14 so that the horizontal plane laid out by the free ends 13 is arranged above the horizontal plane extending through the central portion 12.

Figure 2:
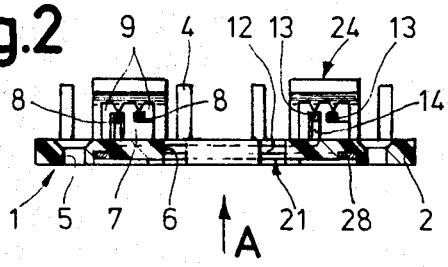
FIG. 2 is a sectional view taken on line 2—2 in FIG. 1.
Figure 8:
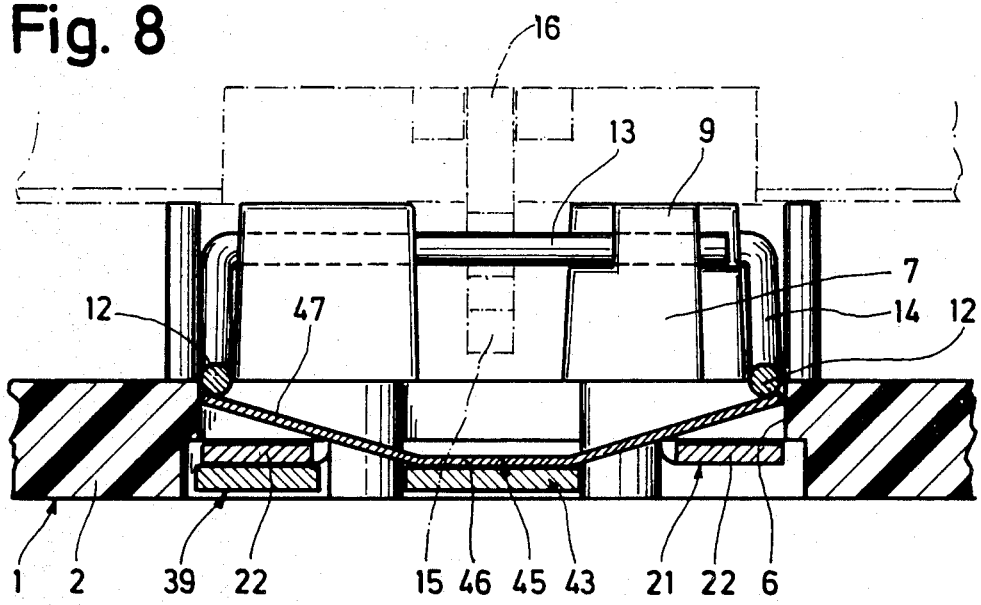
FIG. 8 is an enlarged sectional view taken on line 8—8 in FIG. 5.

The spring wire 10 is pressed with its free ends 13 into grooves 8 of the two spacers 7 in such a way that the free ends 13 extend parallel to the narrow edge of the coupling member, while the central portion 12 rests on the upper side of the base plate 2 and spans the two parallel portions of the opening 6 (see FIGS. 1, 2 and 8). The other spring wire 11 is pressed in the reverse direction with its free ends into the second pair of grooves of the two spacers 7, its central portion similarly rests on the upper side of the base plate and spans the two parallel portions of the H-shaped opening 6 on the opposite side.

The free ends 13 of the two spring wires 10 extend parallel to each other between the two spacers 7 on each side of the opening 6, and, in the area between the two spacers, they can be elastically bent apart. In this area, the free ends of the two spring wires form a locking element for a projection 15 which is provided with a recess and, in the illustrated embodiment, is integrally joined to a central conductor rail 16 which, in turn, is held in insulated relation to a metallic bed member 17 of a rail section 18, on the bed member 17. The projection 15 protrudes downwardly out of the bed member 17 so that when the bed member 17 is pressed onto the coupling member 1, the projection provided with a recess elastically engages between the free ends 13 of the two spring wires 10 and 11. This engagement is facilitated by the guide pegs 4 of the coupling member cooperating with corresponding guide walls 19 which project downwardly at the bed member 17 to guide the bed member relative to the coupling member when they are pushed together. The guide walls 19 may be part of an electrically insulating plastic insert 20 inserted into the metallic bed member 17.

The distances between the projections 15 and the end of a rail section 18 are selected such that the rail sections are fixed in immediately adjacent relation to each other when the projections engage between the spring wire ends. In this case, the spring wires establish not only a mechanical locking of the two rail sections but also simultaneously an electrical connection between the central conductor rails of the two rail sections.

Figure 4:
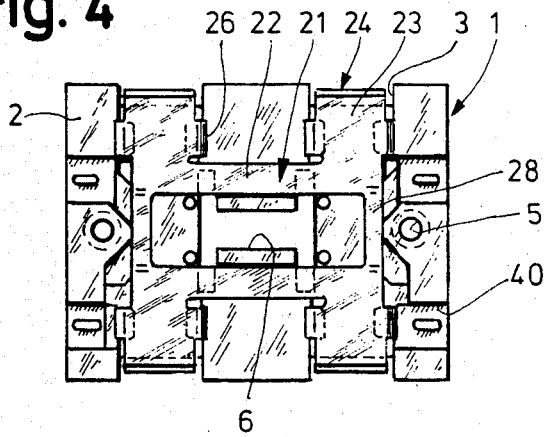
FIG. 4 is a view of the coupling member in the direction of arrow A in FIG. 2.
Figure 5:
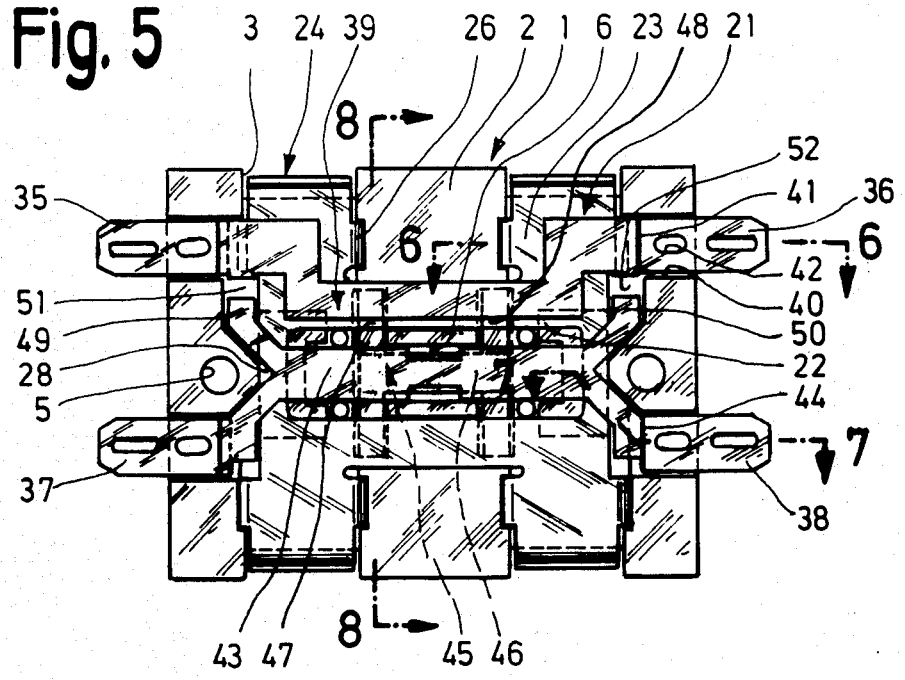
FIG. 5 is a view similar to FIG. 4, but with the contact spring, the contact member and the connecting element.
Figure 6:
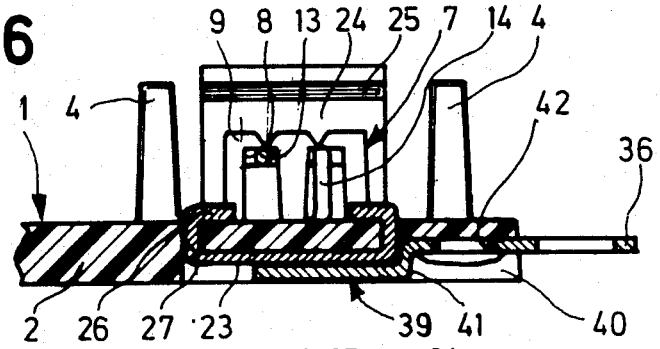
FIG. 6 is a sectional view taken on line 6—6 in FIG. 5.

Arranged on the underside of the coupling member (see FIG. 4) is a substantially plate-shaped metal locking element 21 comprising at the edge of the opening 6, two strips 22 which extend parallel to the longitudinal edge of the coupling member and partially cover the parallel portions of the opening 6 at their ends (see FIGS. 4 and 8). Each strip 22 carries at both of its ends a laterally projecting tab 23 whose width correpsonds to the length of the rectangular cut-out sections 3. This tab 23 is bent upwardly in the cut-out sections 3 in the form of an elastic tongue 24 which extends to approximately the height of the guide pegs 4. At the upper end of the tongue, it is bent inwardly in lined configuration and thus forms a projection 25 protruding inwardly in the form of a shoulder. The tongues 24 on the two strips 22 are arranged in pairs, in each case, in opposite relation to each other. Formed on the tabs 23 are laterally smaller tabs 26 which are inserted through slits 27 in the base plate 2 and are bent laterally on the upper side of the base plate. In this way, the strips and the tabs 23 formed thereon are held on the coupling member 1.

Figure 7:
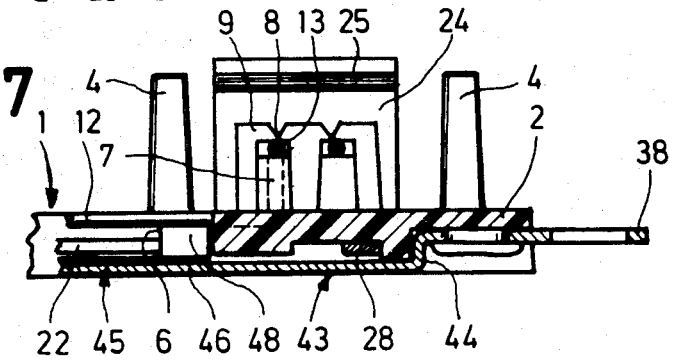
FIG. 7 is a sectional view taken on line 7—7 in FIG. 5.

The oppositely arranged strips 22 are, furthermore, joined together at their ends via narrow webs 28 which in relation to the plane of the strips 22 and the tabs 23 are set back into the interior of the coupling member (see FIG. 7).

Figure 3:
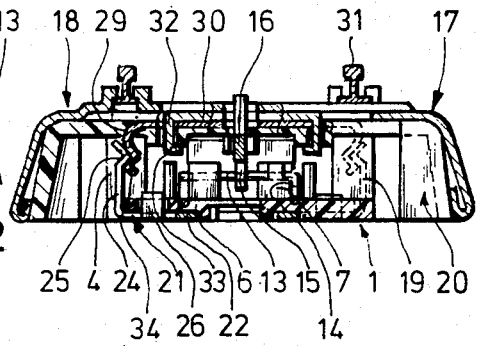
FIG. 3 is a sectional view taken on line 3—3 in FIG. 1.

The upwardly protruding tongues 24 cooperate with elastic tongues 29 which are joined together via a common web 30 pressed by the insert 20 against the underside of the metallic bed member 17. The web 30 and the tongues 29 consist of metal so that, in this way, an electrically conductive connection is established between the tongues 29 and the metallic bed member 17. The bed member, in turn, carries metallic rails 31 in electrically conductive connection therewith, so that the downwardly protruding tongues 29 and the rails 31 are electrically connected. As is apparent from FIG. 3, the insert 20 pressing the web 30 against the bed member 17 is held on the bed member by downwardly protruding tabs 32 punched out of the bed member which extend through slits 33 in the insert 20 and are bent over at the underside of the insert.

The elastic tongues 29 comprise on their outer sides projections 34 protruding in the shape of a shoulder, which engage behind the corresponding projections 25 of the elastic tongues 24 on their inner side when the rail section is pressed onto a coupling member, which produces a reliable electrical connection between the tongues 29 and the tongues 24. This connection simultaneously serves to mechanically lock the rail section to the coupling member since unintentional withdrawal of the rail section from the coupling member is prevented by the projections rearwardly engaging one another. At the same time, the two rail sections are also fixed transversely to the direction of travel by the cooperating tongues.

The above-described coupling member enables rail sections to be mechanically and electrically connected to one another in a simple and reliable manner, with both the mechanical and the electrical connection being effected by the same locking means, namely, on the one hand, the locking of the projection 15 of the central conductor rails 16 and the two free ends 13 of the spring wires 10 and 11, and, on the other hand, the locking of the tongues 29 protruding from above and the tongues 24 protruding upwardly from the coupling member.

The embodiment illustrated in FIGS. 5 to 8 is of the same design as that of FIGS. 1 to 4. The same parts have, therefore, been given the same reference numerals.

This embodiment additionally comprises means enabling external electric connections to be made with the rails and the central conductor rails, respectively.

To do so, a plate-shaped metal component is placed on the underside of the coupling member so as to form, in each case, at both narrow edges of the coupling member, two contact lugs 35, 36, 37, 38 protruding over the edges of the coupling member. Electric wires may be soldered to these contact lugs, but it is also possible to put correspondingly shaped plugs on these contact lugs.

The oppositely arranged contact lugs 35 and 36 continue towards the center of the coupling member in the form of a strip-shaped connecting element 39 which, in the area of the tabs 23 and offset laterally towards the center of the area of the strip 22 associated with these two tabs 23, rests with its surface against the tabs 23 and the strip 22 so that an electric contact is established between these parts. The contact lugs 35 and 36 are disposed in a recess 40 on the underside of the coupling member 1 and comprise a step 41 (see FIG. 6) at the edge of the tabs 23. To fix the connecting element 39 to the coupling member 1, there are formed in the strip-shaped connecting element 39, immediately beside the edges of the coupling member 1, holes 42 through which a peg formed on the coupling member 1 extends. Following insertion of the connecting element, this peg is heated and flattened so that the connecting element is thereby held in place on the coupling member 1.

The likewise oppositely arranged contact lugs 37 and 38 are joined to each other via a similarly strip-shaped contact member 43 which extends from the two contact lugs 37 and 38 firstly at an incline to the center of the coupling member and in doing so traverses the locking element arranged thereabove in the area of the webs 28. The webs 28 are upwardly offset in relation to the tabs 23 so that in the bridging area, the strip-shaped contact member 43 is spaced at a distance from the webs 28 which is sufficient to reliably electrically insulate both parts (see FIG. 7). The strip-shaped contact member 43 which, like the connecting element 39 is attached to the coupling member and comprises a step 44 at the transition point between the contact lug and the strip-shaped contact member, is supported on the underside of the coupling member 1, so that even if pressure is applied to the strip-shaped contact member 43, there is no danger of it touching the bridged web 28.

The strip-shaped contact member 43 furthermore also bridges the opening 6. Inserted into this opening 6 is an H-shaped contact spring 45 which rests with the surface of its central web 46 against the contact member 43 bridging the opening 6 and which is supported at the free ends of its parallel webs 47 and 48, which are bent upwardly at a slight incline in relation to the plane of the central web 46, at the central portions 12 of the spring wires 10 and 11 spanning the opening 6. An electric contact is thereby established between the contact lugs 37 and 38, on the one hand, and the spring wires 10 and 11, on the other hand, by means of which the contact lugs 37 and 38 are electrically connected to the central conductor rail when the rail section is set on.

In the illustrated embodiment, the connecting element 39 with the contact lugs 35 and 36 and also the contact member 43 with the contact lugs 37 and 38 are set as an integral component joined by webs 49 and 50 onto the coupling member and joined thereto in the described manner. The webs 49 and 50 are subsequently severed in the areas 51 and 52 so that the connecting element and the contact member are electrically insulated from one another.

This design enables the coupling member to be selectively constructed as simple coupling member or as connection and coupling member. In order to convert a normal coupling member, as illustrated in FIGS. 1 to 4, into a connection member in accordance with FIGS. 5 to 8, it is sufficient to insert therein the H-shaped contact spring 45 and to then set the component consisting of the connecting element and the contact member and the contact lugs belonging thereto, onto the underside. After the component has been attached, and the webs 49 and 50 have been severed, the connecting element is ready for use.

We claim:

1. A coupling for two adjacent rail sections of a model railway comprising a bed member with rails and a conductor rail held thereon, projections in electrically conductive connection with said rail and said conductor rail, a coupling member arranged beneath said adjacent bed members and carrying at least two upwardly open locking elements that are separate from one another and consist of electrically conductive material which is elastically deformable, said projections engaging said locking elements from above, whereby each of the projections on the adjacent rail sections are mechanically and electrically connectable to one another via one locking element, characterized in that one locking element comprises upwardly protruding elastic tongues, with the projections engaging this locking element resting thereagainst, and the other said locking element comprises for each projection (15) of the two adjacent rail sections (18) two spring wires (10, 11) extending parallel to each other, whose distance apart is set by atC least one spacer (7), and wherein said projection (15) is provided with a recess and is insertable between these spring wires (10, 11) in an insertion area beside the spacer (7) in which said spring-wires can be elastically bent apart.

2. The coupling as defined in claim 1, characterized in that the spring wires (10, 11) are fixed in mutually spaced relation to each other on both sides of the insertion area by a spacer (7).

3. The coupling as defined in claim 1, characterized in that the spring wires (10, 11) are arranged transversely to the direction of travel in the insertion area.

4. The coupling as defined in claim 1, characterized in that the two insertion areas for the projections (15) which correspond to each other on the adjacent rail sections (18) are formed by the same spring wires (10, 11).

5. The coupling as defined in claim 4, characterized in that each spring wire (10, 11) comprises a central portion (12) and free ends (13) adjoining said central portion at right angles on either side, and in that the two spring wires (10, 11) are offset in relation to each other in the longitudinal direction of the central portion (12) on the coupling member (1) and with their free ends (13) pointing in the opposite direction, are arranged in such a way that the free ends (13) of the two spring wires (10, 11) extend parallel to each other at least over part of their longitudinal extent.

6. The coupling as defined in claim 5, characterized in that the central portions (12) rest against an upper side of the coupling member (1), and in that the angular free ends (13) are arranged in a plane extending above the upper side of the coupling member (1) in spaced relation to the upper side of the coupling member (1).

7. The coupling as defined in claim 1, characterized in that each spacer (7) comprises two upwardly open, parallel grooves (8) with laterally arranged, elastic detents (9) which the spring wires (10, 11) engages from above.

8. The coupling as defined in claim 1, characterized in that the locking element (21) carrying elastic tongues (24) is arranged on the underside of the coupling member (1), and in that the elastic tongues (24) protrude upwardly at opposite edges of the coupling member (1) beyond a base plate (2) of the coupling member (1).

9. The coupling as defined in claim 8, characterized in that the tongues (24) carry projections at their upper ends which engage (25) corresponding projections (34) on elastic tongues (29) protruding downwardly from the bed member (17).

10. The coupling as defined in claim 9, characterized in that said bed member (17) is made of electrically conductive material, the rails are held in electrically conductive connection therewith, the conductor rail (16) is held in electrically insulated relation thereto, and the tongues (29) protruding downwardly from the bed member (17) are in electrically conductive connection with the bed member (17).

11. The coupling as defined in claim 8, characterized in that the locking element (21) carrying the elastic tongues (24) comprises two flat strips (22) extending parallel to the rail direction and resting against the underside of the coupling member (1), in that the elastic tongues (24) protruding upwardly at the adjacent edge of the coupling member (1) are formed on each strip (22), and in that the two strips (22) are in electrically conductive connection with each other via two webs (28) extending parallel to each other and perpendicularly to the strips (22).

12. The coupling as defined in claim 11, characterized in that the strips (22), the tongues (24) and the webs (28) are of integral construction.

13. The coupling as defined in claim 11, characterized in that a connecting element (39) on the underside of the coupling member (1) protrudes beyond the outer contour of the coupling member (1) in the form of a contact lug (35, 36) and rests in electrically conductive contact against the portion of the locking element (21) carrying the elastic tongues (24) that extends on the underside of the coupling member (1).

14. The coupling as defined in claim 13, characterized in that the connecting element (39) rests along one of the two strips (22) on the locking element (21).

15. The coupling as defined in claim 14, characterized in that the connecting element (39) is fixed in downwardly open recesses (40) of the coupling member (1).

16. The coupling as defined in claim 6, characterized in that the central portions (12) of the two spring wires (10, 11) span an opening (6) in the coupling member (1), in that a contact spring (45) which rests against the central portions (12) of both spring wires (10, 11) is arranged in this opening (6), and in that a contact member (43) made of electrically conductive material which presses the contact spring (45) against the spring wires (10, 11) is held on the underside of the coupling member (1) and protrudes beyond the outer contour of the coupling member (1) in the form of a contact lug (37, 38).

17. The coupling as defined in claim 16, characterized in that opening (6) and contact spring (45) are H-shaped, so that the contact spring (45) rests with two spring arms (webs 47, 48) against each central portion (12).

18. The coupling as defined in claim 16, characterized in that the locking element comprises two flat strips extending parallel to the rail direction, resting against the underside of the coupling member, and in electrically conductive connection with each other via two webs, and the contact member (43) extends in spaced relation beneath the webs (28) which join the two strips (22) of the locking element (21) and which in relation to the strips (22) of the locking element (21) are set back into the interior of the coupling member (1).

19. The coupling as defined in claim 16, characterized in that the connecting element (39) resting against the locking element (21) and the contact member (43) form an integral component which is attached to the coupling member (1) and which in its assembled position on the coupling member (1) is separable into two parts which are electrically insulated from each other by severing two webs (49, 50) joining the contact member (43) and the connecting element (39).

20. The coupling as defined in claim 13, characterized in that the connecting element (39) and the contact member (43), in each case, protrude beyond opposite sides of the coupling member (1) in the form of a contact lug (35, 36; 37, 38).

* * * * *